US007093571B2

(12) United States Patent
Katsumata

(10) Patent No.: US 7,093,571 B2
(45) Date of Patent: Aug. 22, 2006

(54) INTERNAL COMBUSTION ENGINE

(75) Inventor: Shouji Katsumata, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/629,609

(22) Filed: Jul. 30, 2003

(65) Prior Publication Data

US 2004/0040530 A1 Mar. 4, 2004

(30) Foreign Application Priority Data

Aug. 27, 2002 (JP) ..... 2002-247590

(51) Int. Cl.
*F01L 9/04* (2006.01)

(52) U.S. Cl. ..... 123/90.11; 123/90.31; 123/90.34

(58) Field of Classification Search ..... 123/90.1, 123/90.11, 90.33, 90.38, 196 R, 196 A, 196 M, 123/198 F, 193.5, 193.3, 193.2, 90.48, 90.34, 123/90.35, 90.16, 90.27, 90.31
See application file for complete search history.

(56) References Cited

U.S. PATENT DOCUMENTS 4,777,915 A * 10/1988 Bonvallet ..... 123/90.11
5,036,807 A * 8/1991 Kaneko ..... 123/90.16
5,220,891 A * 6/1993 Nakamura et al. ..... 123/90.16
5,400,747 A * 3/1995 Tabata et al. ..... 123/90.17
5,529,030 A * 6/1996 Rose ..... 123/90.12
5,680,841 A * 10/1997 Hu ..... 123/322
5,875,754 A * 3/1999 Ickinger ..... 123/193.5
5,937,808 A * 8/1999 Kako et al. ..... 123/90.15
6,138,621 A * 10/2000 Albanello et al. ..... 123/90.12
6,302,071 B1 * 10/2001 Kobayashi ..... 123/90.16
6,655,329 B1 * 12/2003 Kammerdiener et al. 123/90.16

FOREIGN PATENT DOCUMENTS

DE 4132500 A1 * 4/1993
JP 06159021 A1 * 6/1994
JP A 11-36829 2/1999
JP A 2001-355417 12/2001
JP 2002106373 A * 4/2002

OTHER PUBLICATIONS

"Electromagnetic Valve Control (EVC) A Future Technology to reduce Fuel Consumption In the Conflict between Variability, Complexity and Costs", DaimlerChrysler AG, Mercedes-Benz Technology Center, Stuttgart, pp. 30-53 (with Abstract).

* cited by examiner

*Primary Examiner*—Thomas Denion
*Assistant Examiner*—Ching Chang
(74) *Attorney, Agent, or Firm*—Oliff & Berridge, PLC

(57) ABSTRACT

In an internal combustion engine having an electromagnetically driven valve for driving one of an intake valve and an exhasut valve, at least a lubricating oil passage to a head section including a lubricating oil passage to the electromagnetically driven valve is provided independently from other lubricating oil passage such that the lubricating oil for the electromagnetically driven valve is not mixed with the other lubricating oil. A lubricating device is allowed to have a portion where the lubricating oil is commonly used so long as the lubricating oil for the electromagnetically driven valve and the lubricating oil for the other elements are not mixed.

9 Claims, 7 Drawing Sheets

INTERNAL COMBUSTION ENGINE

The disclosure of Japanese Patent Application No.2002-247590 filed on Aug. 27, 2002, including the specification, drawings and abstract are incorporated herein by reference in its entirety.

BACKGROUND OF THE INVENTION

1. Field of Invention

The invention relates to an internal combustion engine and more particularly, to a lubricating oil passage in the internal combustion engine.

2. Description of Related Art

In an internal combustion engine, a cam driven valve has been generally employed for an intake valve and an exhaust valve. Recently, an electromagnetically driven valve has been employed as the intake valve or the exhaust valve in place of the cam driven valve. For example, JP-A-11-36829 discloses a full cam-less structure in which the electromagnetically driven valve is employed as both the intake and the exhaust valves, and lubricating oil is supplied to a portion that slides along with the opening/closing operation of the valve body. JP-A-2001-355417 also discloses the electromagnetically driven valve employed in the internal combustion engine.

The lubricating oil for the intake/exhaust valves is generally supplied from a lubricating oil supply system that supplies the lubricating oil to an engine body such as a piston rod within the cylinder block. If the electromagnetically driven valve is employed in the above-structured internal combustion engine, the drawback may occur as described below.

Required properties of the lubricating oil for the electromagnetically driven valve should be different from those of the lubricating oil supplied to a body of an engine. Accordingly, the common use of the lubricating oil both for the electromagnetically driven valve and the engine body may cause any one of them to be brought into the inappropriate state with respect to its performance. The lubricating oil for the engine body is likely to be degraded under the influence of an operation state of the engine. It is, therefore, not appropriate to use the lubricating oil that has been supplied to the engine body for lubricating the electromagnetically driven valve. In the aforementioned case, that is, the degraded lubricating oil is supplied to the electromagnetically driven valve, it may perform its function inappropriately, thus causing the engine to stop, increasing the power consumption, failing to start the engine at low temperatures, and the like.

JP-A-11-36829 discloses the lubricating oil supply mechanism for supplying the lubricating oil to the portion that slides along with the opening/closing operation of the body of the electromagnetically driven valve in the full cam-less structure. The lubricating oil supply mechanism allows the lubricating oil to be supplied only to the electromagnetically driven valve independently from the supply of the lubricating oil to the engine body.

Meanwhile, in an internal combustion engine with the half cam-less structure having the electromagnetically driven valve as one of the intake or the exhaust valves, and the cam driven valve as the other valve. The above-structured internal combustion engine provides advantageous features of the cost reduction, being substantially equivalent to the fuel efficiency obtained in the full cam-less structure. However, it is necessary to consider the system for supplying two types of the lubricating oil to the cam driven valve and the electromagnetically driven valve as being the intake and the exhaust valves. There is disclosed no lubricating oil supply system employed in the internal combustion engine having the lubricating oil supply device with the half cam-less structure.

SUMMARY OF THE INVENTION

It is an object of the invention to provide an internal combustion engine having a half cam-less structure where an electromagnetically driven valve is provided functioning as one of the intake valve and the exhaust valve in which the lubricating oil for the electromagnetically driven valve is not influenced by the other lubricating oil.

According to an embodiment of the invention, in an internal combustion engine having the electromagnetically driven valve for driving one of the intake and exhasut valves, the lubricating oil passage for the electromagnetically driven valve is separated from the other lubricating oil passage for the elements other than the electromagnetically driven valve such that the lubricating oil for the electromagnetically driven valve is not influenced by the lubricating oil supplied through the other lubricating oil passage. This makes it possible to prevent mixture of the different types of the lubricating oil for the electromagnetically driven valve and for the elements other than the electromagnetically driven valve. The lubricating oil supply mechanism may have a portion where the lubricating oil is commonly used so long as those different types of the lubricating oil cannot be mixed with each other.

The invention is applied to an internal combustion engine having a half cam-less structure including an electromagnetically driven valve that serves to drive one of an intake valve and an exhaust valve, and a cam driven valve that serves to drive the other valve. In the above structured internal combustion engine, at least two lubricating oil passages are independently formed with each other. One of those lubricating oil passages is formed to the electromagnetically driven valve.

The internal combustion engine includes a head section that includes the electromagnetically driven valve and the cam driven valve, and a block section that includes a piston and a crankshaft connected thereto. It is preferable to form a first lubricating oil passage to the head section including the lubricating oil passage to the electromagnetically driven valve, and a second lubricating oil passage to the block section. The second lubricating oil passage is formed independently from the first lubricating oil passage. In this case, the lubricating oil passage to the electromagnetically driven valve may include a lubricating oil passage to the cam driven valve. The lubricating oil passage to the electromagnetically driven valve and the lubricating oil passage to the cam driven valve may be independently formed. Further the lubricating oil passage to the electromagnetically driven valve, the lubricating oil passage to the cam driven valve, and the second lubricating oil passage to the block section may be independently formed.

As the lubricating oil passage to the electromagnetically driven valve is provided separately from the other lubricating oil passage, the lubricating oil for the electromagnetically drien valve is not mixed with the other lubricant oil. Accordingly, the electromagnetically driven valve is not influenced by the other type of the lubricating oil that has been degraded in the process of lubricating the elements, for example, in the cylinder block. The lubricating oil for the elements in the cylinder block is likely to be degraded owing to mixture with the blow-by gas or the use at the relatively higher temperatures. Supposing that the aforementioned type of the lubricating oil is used for the electromagnetically driven valve, the degraded lubricating oil may be supplied thereto. This may cause failure in the operation of the electromagnetically driven valve, resulting in engine stall. Moreover, in the above-described operating environment, the viscosity of the lubricating oil for the electromagnetically driven valve may vary to increase friction. This may increase the power consumption, and further cause failure in starting the engine at lower temperatures. The aforementioned problem may be solved by the invention.

It is preferable that the lubricating oil supplied through the lubricating oil passage to the electromagnetically driven valve has a different type, that is, different viscosity from that of lubricating oil supplied through the other lubricating oil passage. Generally the lubricating oil for the elements in the cylinder block may be commonly used for lubricating the area around the camshaft of the cam driven valve. However, the desired viscosity of the lubricating oil for the slide portion of the electromagnetically driven valve is different from that of the lubricating oil for the area around the camshaft or the engine body. If different type of the lubricating oil, that is, with different viscosity, is used in the same lubricating oil passage, those types of the lubricating oil are mixed, causing change in the viscosity in each of those types of lubricating oil. The viscosity of the lubricating oil for the electromagnetically driven valve is expected to become higher after the mixture. As a result, friction with respect to the slide portion of the valve may be increased, resulting in increased power consumption. This may further prevent the electromagnetically driven valve from being normally operated, thus causing engine stall. This may take a longer time for starting the internal combustion engine at lower temperatures, or in the worst case, result in difficulty in starting the engine.

Meanwhile the viscosity of the lubricating oil for the engine body is expected to become lower after the mixture. This may cause seizure in a portion, especially at a high rotational speed, and high temperature, between the piston and the cylinder bore, or the crank metal and the connecting rod metal. This may further cause extraordinary friction in a part of the engine body, for example, the crankshaft, cylinder bore, and the like. Providing independent lubricating oil passages for the respective types of the lubricating oil is required to avoid the aforementioned problem.

In the embodiment of the invention, the properties of the lubricating oil supplied through the lubricating oil passage for the electromagnetically driven valve are different from the lubricating oil supplied through the other lubricating oil passage for efficiently lubricating the respective elements. It is to be understood that the different property of the lubricating oil is not limited to the "viscosity". It is more preferable to use three types of the lubricating oil for the electromagnetically driven valve, the cam driven valve (camshaft), and the elements in the cylinder block such as the crankshaft.

DETAILED DESCRIPTION OF PREFERRED EMBODIMENTS

Figure 1:
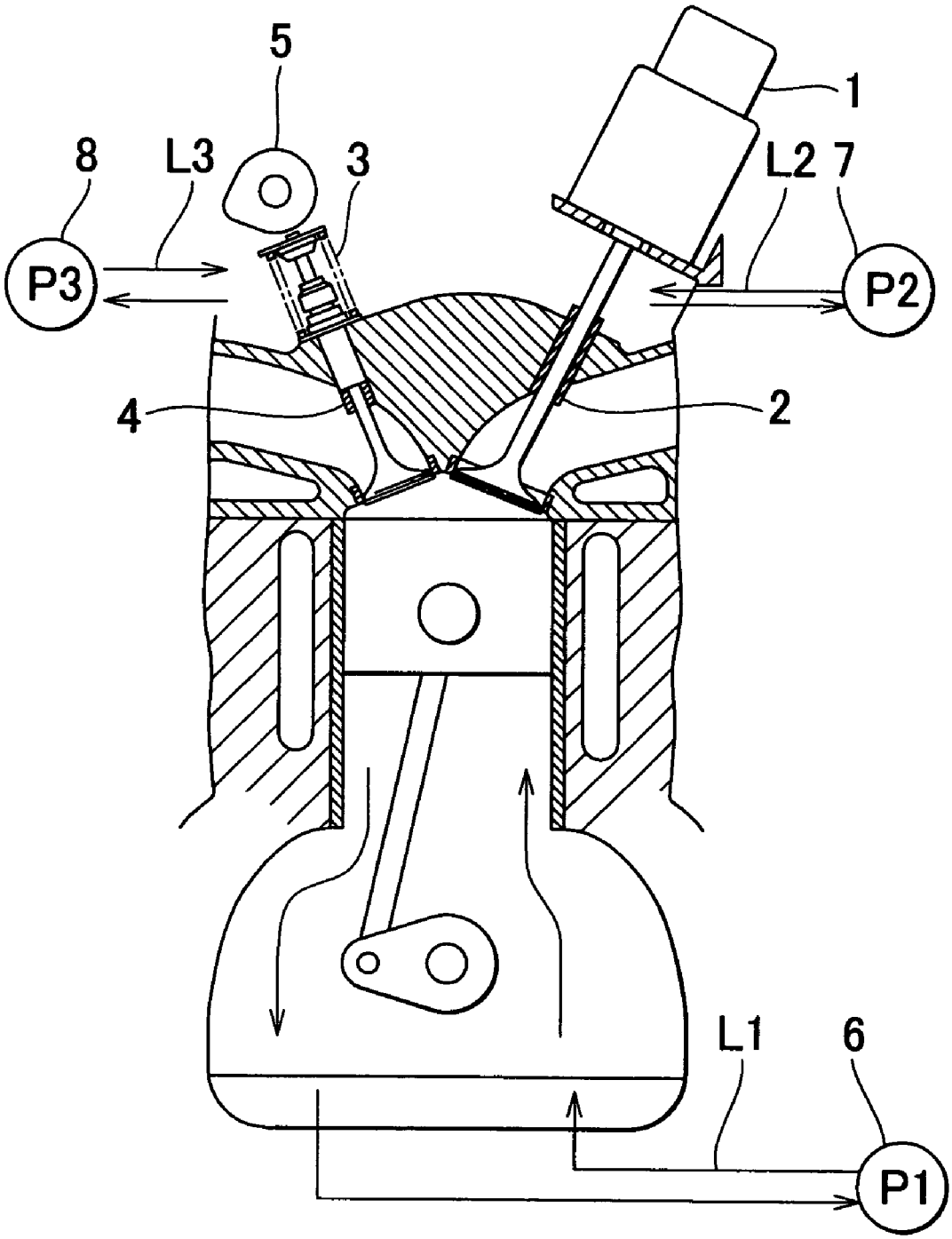
FIG. 1 is a schematic view of an internal combustion engine according to the invention.

Embodiments of the invention will be described referring to the drawings. An example of an internal combustion engine having an electromagnetically driven valve is described referring to FIG. 1. FIG. 1 represents a gasoline engine of a half cam-less structure. The engine includes the electromagnetically driven valve 1 that serves to open and close an intake valve 2, and a cam driven valve 3 that serves to open and close an exhaust valve 4.

A lubricating device 6 for lubricating elements in a cylinder block such as a crankshaft (including a lubricating oil passage L1) includes a first oil pump P1 for supplying the lubricating oil to the cylinder block side. A first lubricating device 7 for lubricating elements in a cylinder head (including a lubricating oil passage L2) includes a second oil pump P2 for supplying the lubricating oil to the electromagnetically driven valve 1. A second lubricating device 8 (including a lubricating oil passage L3) includes a third oil pump P3 for supplying the lubricating oil to the cam driven valve 3 at the cylinder head side.

There are three types of lubricating devices, that is, the lubricating device 6, the first lubricating device 7 for lubricating the electromagnetically driven valve 1, and the second lubricating device 8 for lubricating the cam driven valve. The lubricating devices as described above may be embodied into three forms from (A) to (C) as follows:

(A) respective functions of the lubricating device 6 and the second lubricating device 8 are performed by a common lubricating device;

(B) respective functions of the first lubricating device 7 and the second lubricating device 8 are performed by a common lubricating device; and (C) respective functions of the lubricating devices 6, 7, and 8 are independently performed without using common lubricating device.

Figure 2:
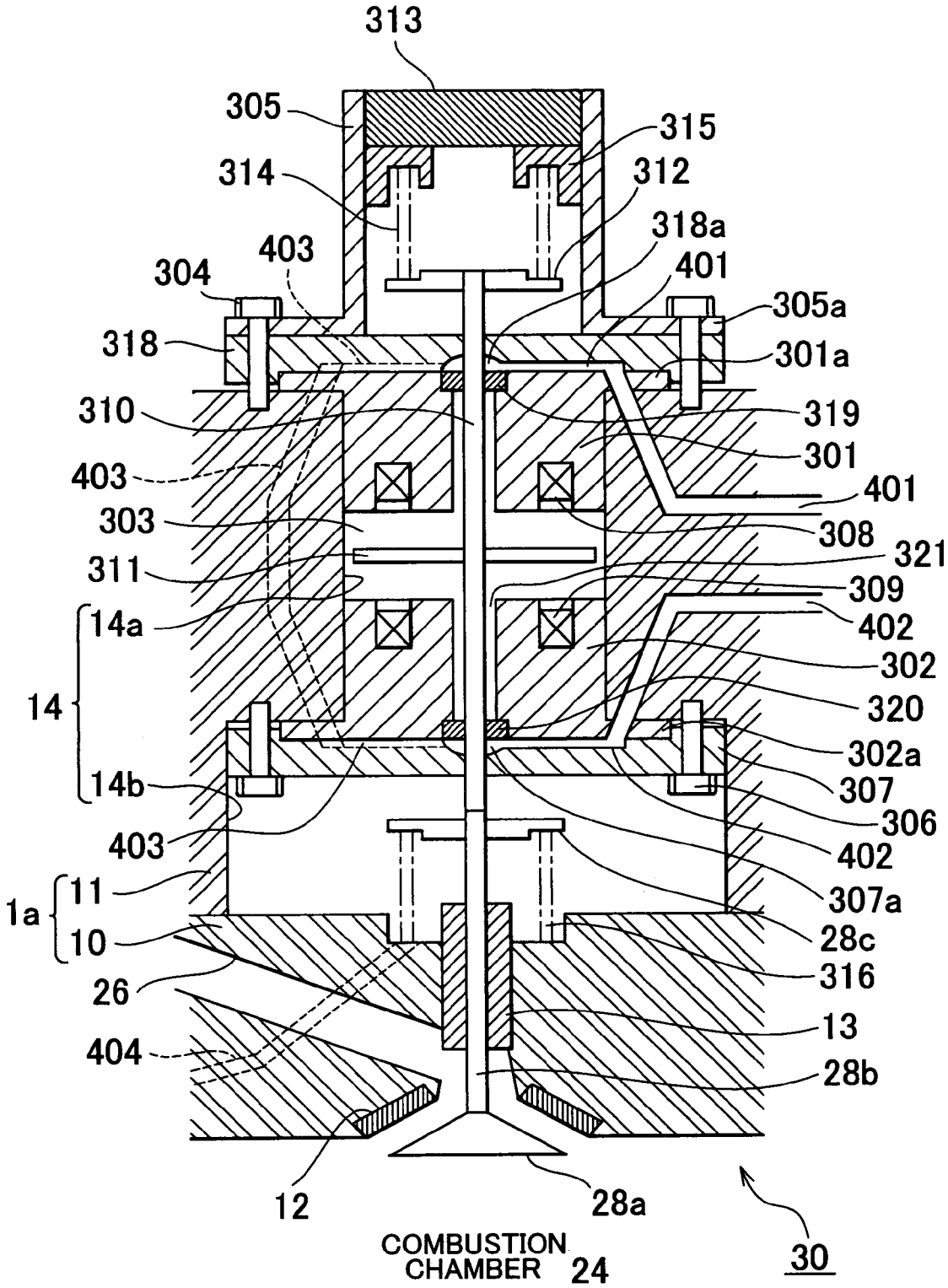
FIG. 2 is an exemplary view of an electromagnetically driven valve and a lubricating mechanism therefor.

The structure of the electromagnetically driven valve and the lubricating oil passage will be described. FIG. 2 shows an example of the structure of an electromagnetic drive mechanism 30 for the intake valve. A cylinder head 1*a* of the internal combustion engine includes a lower head 10 fixed to the upper surface of the cylinder block, and an upper head 11 provided on the upper portion of the lower head 10.

The lower head 10 has two intake ports 26 for each cylinder. An opening end of the intake port 26 at the side of a combustion chamber 24 is provided with a valve seat 12 on which a valve body 28*a* of an intake valve 28 is seated.

The lower head 10 has a hole with a circular cross section formed from the inner wall surface of the intake port 26 to the upper surface of the lower head 10 such that a cylindrical valve guide 13 is inserted therethrough. A valve shaft 28*b* of the intake valve 28 pierces through an inner hole of the valve guide 13 such that the valve shaft 28*b* slidably moves in the axial direction.

In the upper head 11, a core attaching hole 14 through which a first core 301 and a second core 302 are fit is formed coaxially with the valve guide 13. A lower portion 14*b* of the core attaching hole 14 has a diameter larger than that of an upper portion 14*a* of the core attaching hole 14. The lower portion 14*b* will be hereinafter referred to as a large diameter portion, and the upper portion 14*a* will be hereinafter referred to as a small diameter portion.

The first core 301 and the second core 302 each formed of a soft magnetic material are fit in the small diameter portion 14*a* in series at a predetermined space 303. The upper end of the first core 301 and the lower end of the second core 302 have a flange 301*a* and a flange 302*a*, respectively. The first core 301 and the second core 302 are inserted into the core attaching hole 14 from the upper side and the lower side, respectively. The first and the second cores 301, 302 are positioned when the flanges 301*a*, 302*a* are brought into abutment on the edges of the core attaching hole 14 such that the predetermined space 303 is held between those first and the second cores 301, 302. An upper plate 318 with its diameter larger than that of the large diameter portion 14*a* is disposed on the upper portion of the first core 301, and an upper cap 305 having a cylindrical flange 305*a* is disposed on the upper portion of the upper plate 318 around its lower end.

The upper cap 305 and the upper plate 318 are fixed to the upper surface of the upper head 11 with a bolt 304 screwed into the upper head 11. The upper cap 305 and the upper plate 318 are fixed to the upper head 11 in the state where the lower end of the upper cap 305 including the flange portion 305*a* abuts on the upper surface of the upper plate 318, and the lower surface of the upper plate 318 abuts on the upper peripheral surface of the first core 301. As a result, the first core 301 is fixed to the upper head 11.

A lower plate 307 having a width substantially equal to that of the large diameter portion 14*b* of the core attaching hole 14 is provided downward of the second core 302. The lower plate 307 is fixed to a stepped surface that faces downward between the small diameter portion 14*a* and the large diameter portion 14*b* using a bolt 306 that pierces from the lower surface of the lower plate 307 to the upper head 11. In this case, the lower plate 307 is fixed to be in abutment on the lower peripheral surface of the second core 302. As a result, the second core 302 is fixed to the upper head 11.

A first electromagnetic coil 308 is held in a groove formed in the first core 301 at the side of the space 303. A second electromagnetic coil 309 is held in a groove formed in the second core 302 at the side of the space 303. The first and the second electromagnetic coils 308 and 309 are placed so as to face with each other with respect to the space 303. The first and the second electromagnetic coils 308, 309 are electrically coupled with a drive circuit at the intake side. The first core 301 and the first electromagnetic coil 308 constitute an electromagnet of the electromagnetic drive mechanism 30. The second core 302 and the second electromagnetic coil 309 constitute the electromagnet as well.

An armature 311 formed of a soft magnetic material is disposed within the space 303. A shaft member 310 formed of a non-magnetic material is fixed to the armature 311 so as to extend from the center thereof along the axial direction and to pierce through the first and the second cores 301, 302. The shaft member 310 serves as an armature shaft that transmits the displacement of the armature 311 to the valve body 28*a*. The top end of the shaft member 310 pierces through the first core 301 to reach into the upper cap 305, and the lower end pierces through the second core 302 to reach into the large diameter portion 14*b*.

Each end of the passage 321 from the upper surface of the first core 301 to the lower surface of the second core 302 is provided with an annular upper bush 319 and an annular lower bush 320 each having an inner diameter substantially the same as an outer diameter of the shaft member 310. The shaft member 310 is slidably supported in the axial direction by the upper bush 319 and the lower bush 320. In other words, the upper bush 319 and the lower bush 320 constitute a bearing portion that bears the shaft member 310. As described above, the shaft member 310 pierces through the first and the second cores 301, 302 and is supported by the upper bush 319 and the lower bush 320.

The top end of the shaft member 310 that extends into the upper cap 305 is joined with a circular upper retainer 312, and the upper opening portion of the upper cap 305 is screwed with an adjust bolt 313. An upper spring 314 is interposed between the upper retainer 312 and the adjust bolt 313. A spring seat 315 having the outer diameter substantially equal to the inner diameter of the upper cap 305 is disposed in the abutment surface between the adjust bolt 313 and the upper spring 314.

The lower end of the shaft member 310 that extends into the large diameter portion 14*b* abuts on the top end of the valve shaft 28*b* of the intake valve 28. An outer circumference of the top end of the valve shaft 28*b* is joined with the disc-like lower retainer 28*c*. A lower spring 316 is interposed between the lower surface of the lower retainer 28*c* and the upper surface of the lower head 10.

The electromagnetic drive mechanism 30 for the intake side has a lubricating mechanism in order to reduce the sliding resistance between the shaft member 310 and the upper bush 319, and the shaft member 310 and the lower bush 320. The lubricating mechanism includes an upper side recess portion 318*a* with an annular shape provided on a position that faces the upper surface of the upper bush 319 in the lower surface of the upper plate 318, an annular lower side recess portion 307*a* provided on a position that faces the lower bush 320 in the upper surface of the lower plate 307, an upper side oil passage 401 that guides the lubricating oil discharged from the oil pump P2 (not shown) to the upper side recess portion 318*a*, a lower side oil passage 402 that guides the lubricating oil discharged from the oil pump to the lower side recess portion 307*a*; a communication passage 403 that guides a surplus lubricating oil supplied to the upper side recess portion 318*a* to the lower side recess portion 397*a*; and a return passage 404 that returns the lubricating oil dropped into the large diameter portion 14*b* through the space from the lower side recess portion 307*a* to the gap between the shaft member 310 and the shaft member 310 and the lower plate 307.

Referring to FIG. 2, the upper side oil passage 401 extends from the oil pump P2 to reach the upper side recess portion 318*a* via the upper head 11, the flange 301*a* of the first core 301, and the inside of the upper plate 318. The lower side oil passage 402 extends from the oil pump to reach the lower side recess portion 307*a* via the upper head 11, the second core 302 and the inside of the lower plate 307. The communication passage 403 extends from the upper side recess portion 318*a* to reach the lower side recess portion 307*a* via the upper plate 318, the flange 301*a* of the first core 301, the upper head 11, the flange 302*a* of the second core 302, and the inside of the lower plate 307. The return passage 404 is structured to reach the reservoir (not shown) from the large diameter portion 14*b* via the inside of the lower head 10. Each structure of the aforementioned upper side oil passage 401, the lower side oil passage 402, the communication passage 403 and the return passage 404 is not limited to the example as shown in FIG. 2.

Figure 3:
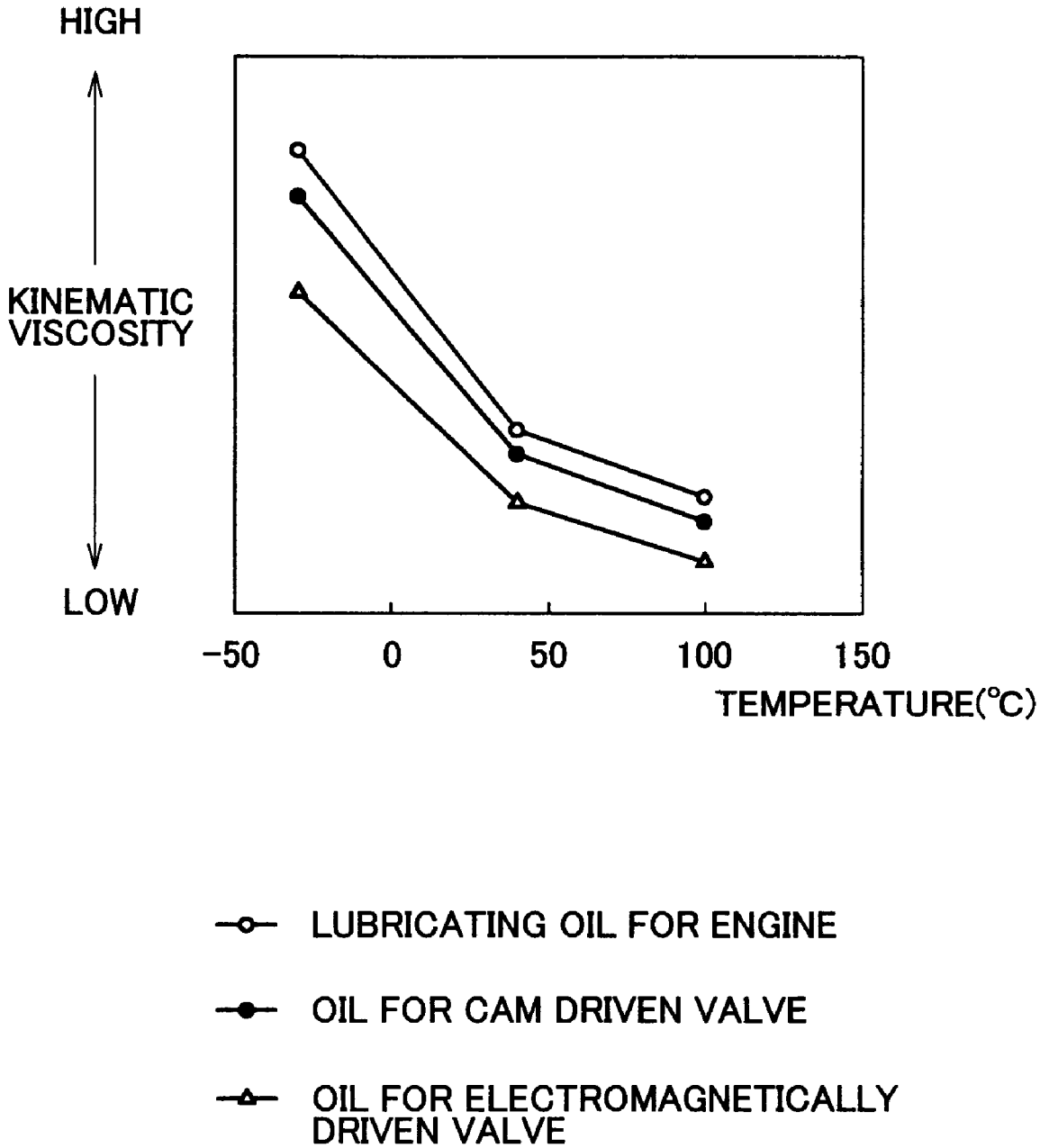
FIG. 3 is a graph showing each viscosity of different types of the lubricating oil.
Figure 4:
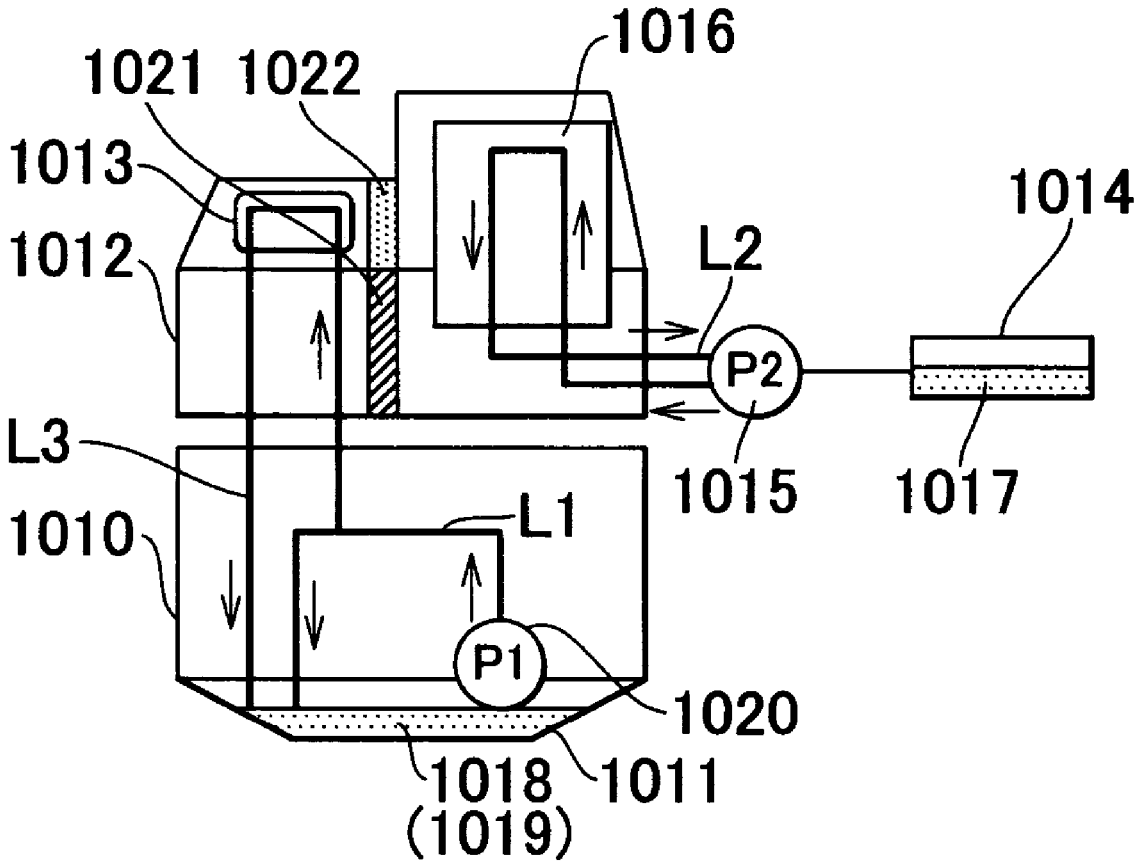
FIG. 4 is a view showing a first embodiment for lubricating the internal combustion engine having the half-cam-less structure.
Figure 5:
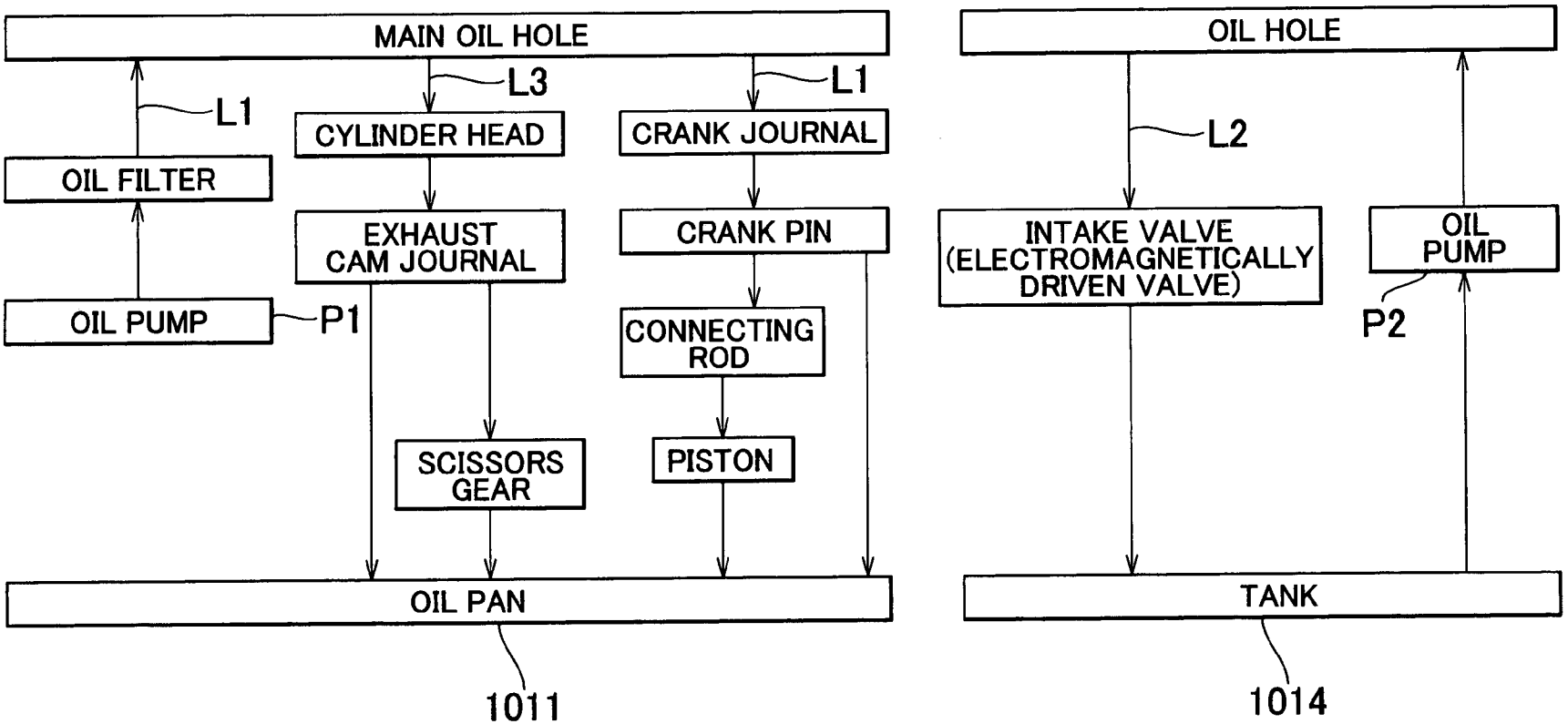
FIG. 5 is a view showing a lubricating oil path according to the first embodiment.

Embodiments of the electromagnetically driven valve and the lubricating mechanism will be described referring to FIGS. 3 to 9. FIG. 3 is a graph showing each viscosity of different types of the lubricating oil. FIG. 4 is a schematic view of a first embodiment of the invention. FIG. 5 shows a lubricating oil path in the first embodiment. FIGS. 6 to 9 show schematic views of the second to the fifth embodiments of the invention.

FIGS. 4, and 6 to 9 show a cylinder block 1010, an oil pan 1011, a cylinder head 1012, a cam shaft 1013, a tank (reservoir) 1014, a pump 1015, an electromagnetically driven valve 1016, lubricating oil 1017 for the electromagnetically driven valve 1016, lubricating oil 1018 for the cylinder block (engine), lubricating oil 1019 for the cam driven valve, a pump 1020 for the cylinder block, and a partition wall 1021 in the cylinder head cover, a partition wall 1022 in the cylinder head cover, and a pump 1024 for the cam driven valve, and a tank 1025 for the cam driven valve.

Prior to the description of the embodiments, the characteristics of the lubricating oil will be described referring to FIG. 3. FIG. 3 shows a logarithmic graph of the viscosity defined by kinematic viscosity on y-axis and the temperature on x-axis. The line marked with ○ represents the characteristic of the lubricating oil for the engine supplied to the crankshaft and the like in the cylinder block. The line marked with ● represents the characteristic of the lubricating oil for the cam driven valve. The line marked with Δ represents the characteristic of the lubricating oil for the actuator of the electromagnetically driven valve. The viscosity of the lubricating oil for the engine is the highest among those of other types of the lubricating oil. The required viscosity of the lubricating oil for the electromagnetically driven valve is lower than that of the lubricating oil for the engine. The required viscosity of the cam driven valve is close to that of the lubricating oil for the engine rather than that for the electromagnetically driven valve. As the required viscosity of the lubricating oil depends on the element to be lubricated, it is preferable to change the lubricating oil in accordance with the element to be lubricated. However, the same lubricating oil may be used for lubricating the cam driven valve and the engine. The lubricating oil path separated in accordance with the viscosity as the characteristic of the lubricating oil will be described. In this case, the lubricating oil path for at least the electromagnetically driven valve is separated from other lubricating oil path.

First Embodiment

FIG. 4 is a view showing a first embodiment corresponding to (A) having the lubricating oil passage L1 for the cylinder block and the lubricating oil passage L2 for the electromagnetically driven valve in the cylinder head are structured to function independently. The lubricating oil passage L1 supplies the lubricating oil to the lubricating oil passage L3 for the cam driven valve.

The lubricating oil supply path will be described referring to FIG. 5. The lubricating oil pumped by the oil pump P1 from the oil pan 1011 is filtrated through an oil filter, and then supplied from a main oil hole to the cylinder head. The lubricating oil flows through an exhaust cam journal (including the camshaft 1013) for the valve for driving the exhaust valve from the cylinder head for direct lubrication, and returns to the oil pan 1011. A part of the lubricating oil flows through a scissors gear after flowing through the exhaust cam journal, and the returns to the oil pan 1011. The lubricating oil supplied to the main oil hole flows through the crank journal, crank pin, connecting rod, and piston for lubrication, and returns to the oil pan 1011.

The lubricating oil passage L2 provided separately from the other lubricating oil passage serves to supply the lubricating oil to the electromagnetically driven valve that constitutes the intake valve. The lubricating oil is pumped by the oil pump P2 from the reservoir 1014, and supplied to the oil hole. The lubricating oil flows from the oil hole to the electromagnetically valve, and returns to the reservoir 1014. The specific route has been already described before referring to FIG. 2.

The lubricating oil supplied to the actuator for the electromagnetically driven valve in the cylinder head through the lubricating oil passage L2 (for the electromagnetically driven valve as shown in FIG. 3) has the viscosity different from that of the lubricating oil (for the engine) supplied through the lubricating oil passage L1 for the cylinder block. In this embodiment, the lubricating oil supplied through the lubricating oil passage L1 for the cylinder block is used as the lubricating oil supplied through the lubricating oil passage L3 that lubricates the cam shaft (exhaust cam journal) of the cam driven valve.

The respective lubricating oil passages for the electromagnetically driven valve and the cam driven valve are separately provided such that each lubricating oil flows independently so as not to be mixed with each other. The required viscosity of the lubricating oil for the electromagnetically driven valve is different from that of the lubricating oil for the cam driven valve. That is, the viscosity of the lubricating oil in the passage L1 is relatively higher than that of the lubricating oil in the passages L2 or L3. The viscosity of the lubricating oil for the electromagnetically driven valve is required to be relatively lower such that the engine can be started easily at lower temperatures. It is preferable to provide a sealing structure that protects the lubricating oil passage L2 from the blow-by gas between the cylinder block and the cylinder head so as to prevent the actuator for the electromagnetically driven valve from being exposed to the blow-by gas.

The lubricating oil passage L2 for the electromagnetically driven valve is provided separately from the lubricating oil passages L1 (for the cylinder block) and the lubricating oil passage L3 for the cam driven valve. In the aforementioned structure, the lubricating oil for the electromagnetically driven valve is not influenced by the use of the lubricating oil for the engine. This makes it possible to realize appropriate lubrication for the electromagnetically driven valve. In this embodiment, the lubricating oil 1018 for the engine body is supplied through the lubricating oil passage L1 (for the cylinder block) and the lubricating oil passage L3 for the cam driven valve, resulting in cost reduction.

Second Embodiment

Figure 6:
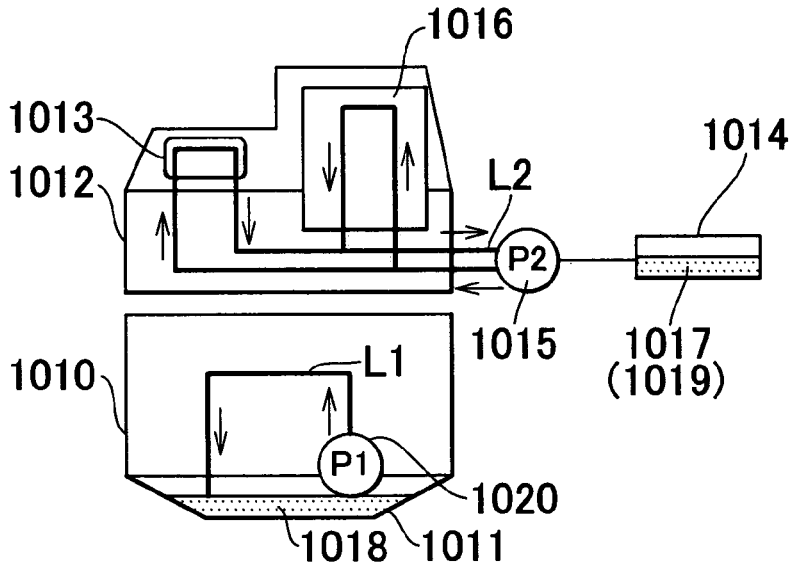
FIG. 6 is a view showing a second embodiment for lubricating the internal combustion engine having the half-cam-less structure.

As shown in FIG. 6, a second embodiment has a structure corresponding to (B) where the lubricating oil passage L1 for the crank shaft of the cylinder block, and the lubricating oil passage L2 for the electromagnetically driven valve and the cam driven valve in the cylinder head are separately provided. The lubricating oil passage L2 is structured to supply the lubricating oil both to the actuator for the electromagnetically driven valve 101 in the cylinder head and the cam shaft for the cam driven valve 1013.

The lubricating oil for the engine as shown in FIG. 3 is supplied through the lubricating oil passage L1, and the lubricating oil for the electromagnetically driven valve or the cam driven valve is supplied through the lubricating oil passage L2. Each viscosity of the respective types of the lubricating oil is different as shown in FIG. 3, that is, the viscosity of the lubricating oil in the lubricating oil passage L1 is relatively higher than that of the lubricating oil in the lubricating oil passage L2. It is preferable to use the lubricating oil exclusively for the electromagnetically driven valve in the lubricating oil passage L2 in consideration with lubrication for the electromagnetically driven valve. The lubricating oil for either the electromagnetically driven valve or the cam driven valve may be used so long as the lubricating oil passage L2 is separated from the lubricating oil passage L1 for the engine in the cylinder block. The lubricating oil for the cam driven valve is considered to have an ability of sufficiently lubricating the electromagnetically driven valve. As the same type of the lubricating oil is used for lubricating the actuator for the electromagnetically driven valve and the cam shaft for the cam driven valve, the structure within the cylinder head does not have to have a member for separating the lubricating oil for the electromagnetically driven valve from that for the cam driven valve, thus simplifying the structure within the cylinder head. The cam shaft and the slide portion between the valve and the valve guide does not have to exhibit higher seizure resistance compared with the slide portion of the cylinder block (between the cylinder bore and the piston, or at the crank shaft metal, connecting rod metal portions). This makes it possible to use the lubricating oil with the viscosity lower than that of the lubricating oil for the cylinder block. The lubricating oil with the viscosity lower than that of the lubricating oil for the engine in the cylinder block side may be used for the actuator of the electromagnetically driven valve. As a result, the friction caused in the slide portion is minimized, thus reducing consumption of power for driving the electromagnetically driven valve.

Third Embodiment

Figure 7:
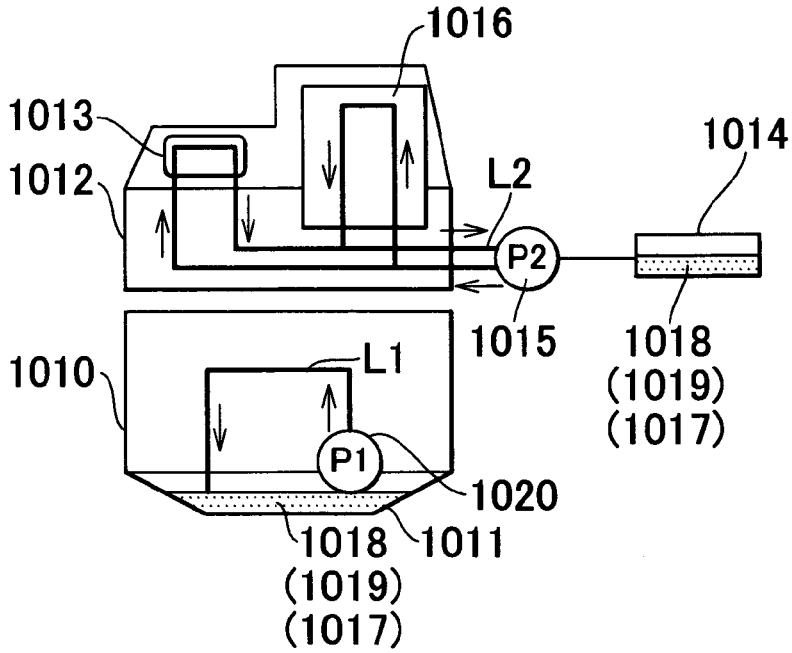
FIG. 7 is a view showing a third embodiment for lubricating the internal combustion engine having the half-cam-less structure.

As shown in FIG. 7, a third embodiment has a structure corresponding to (B) where the lubricating oil passages L1 and L2 are independently provided like the second embodiment. The lubricating oil passage L2 extends to the actuator for the electromagnetically driven valve in the cylinder head and further to the camshaft for the cam driven valve so as to lubricate both valves with the same type of the lubricating oil.

Supposing that elements in the cylinder block can be lubricated with the lubricating oil at relatively lower viscosity, the lubricating oil 1017 for the electromagnetically driven valve or the lubricating oil 1019 for the cam driven valve may be used as the lubricating oil supplied through the lubricating oil passages L1 and L2. In this embodiment, the lubricating oil passage L1 is separately provided from the lubricating oil passage L2. This makes it possible to prevent the use of the lubricating oil that has been degraded by lubricating the elements in the cylinder block within the passage L1 from being supplied to the actuator for the electromagnetically driven valve through the passage L2. Accordingly, the electromagnetically driven valve is allowed to perform normal operations without causing the engine stall. This structure intends to prevent the use of the lubricating oil that is likely to be degraded by mixture of the blow-by gas under the operation environment at relatively a higher temperature through the passage L1 from being supplied to the electromagnetically driven valve through the passage L2.

Supposing that the viscosity of the lubricating oil 1018 for the engine is lowered for reducing the friction and exhibits sufficient lubricating capability, the lubricating oil 1018 may be supplied both to the lubricating oil passages L1 and L2. The lubricating oil in the passage L1 is supplied separately from the passage L2 so as to supply the lubricating oil in the passage L2 that is not influenced by the lubricating oil supplied through the passage L1 to the electromagnetically driven valve.

Fourth Embodiment

Figure 8:
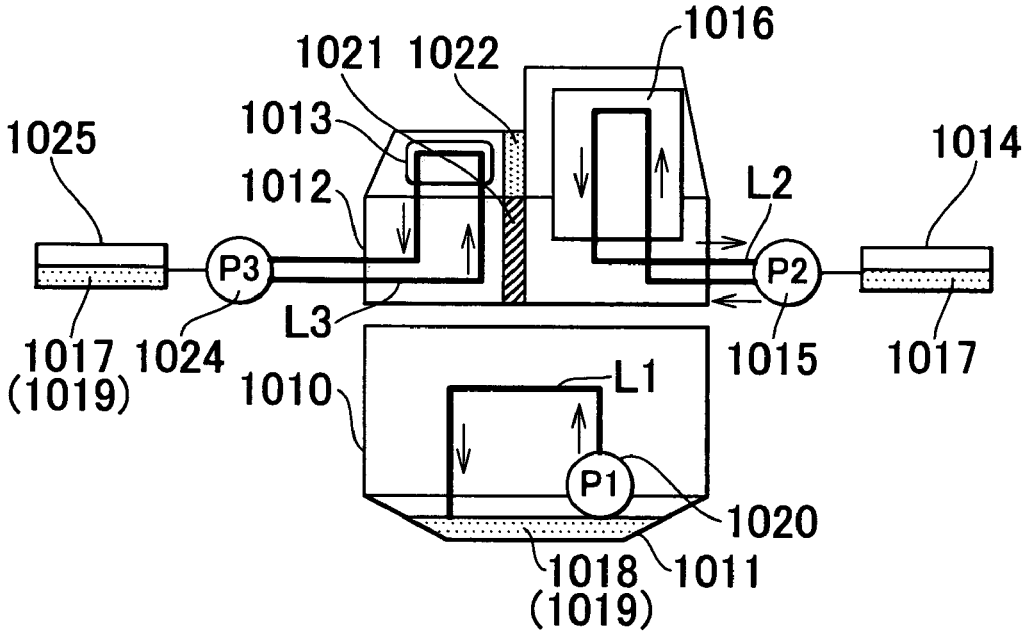
FIG. 8 is a view showing a fourth embodiment for lubricating the internal combustion engine having the half-cam-less structure.

As shown in FIG. 8, a fourth embodiment has a structure corresponding to (C) where the lubricating oil passages L1, L2, and L3 are independently provided. The viscosity of the lubricating oil supplied to the actuator for the electromagnetically driven valve in the cylinder head through the passage L2 is different from that of the lubricating oil supplied to the cam shaft for the cam driven valve through the passage L3. The viscosity of the lubricating oil supplied to the camshaft for the cam driven valve through the passage L3 is equal to that of the lubricating oil supplied through the passage L1.

Each viscosity of the lubricating oil supplied through the passages L1 and L3 is relatively higher than that of the lubricating oil supplied through the passage L2. In this embodiment, the lubricating oil 1018 for the engine or the lubricating oil 1019 for the cam driven valve is used as the lubricating oil supplied through the passages L1 and L3. The lubricating oil 1017 for the electromagnetically driven valve is used as the lubricating oil supplied through the passage L2.

Although the same lubricating oil is supplied to the passages L1 and L3, those passages L1 and L3 are independently provided so as not to supply the is lubricating oil that has been degraded by lubrication through the passage L1 to the passage L3. The lubricating oil 1017 for the electromagnetically driven valve is supplied to the passage L2 so as to maintain the performance of the electromagnetically driven valve sufficiently. The lubricating oil in the passage L2 is not influenced by the lubricating oil in the passages L1 and L3, thus maintaining the performance of the electromagnetically driven valve in better condition.

Fifth Embodiment

Figure 9:
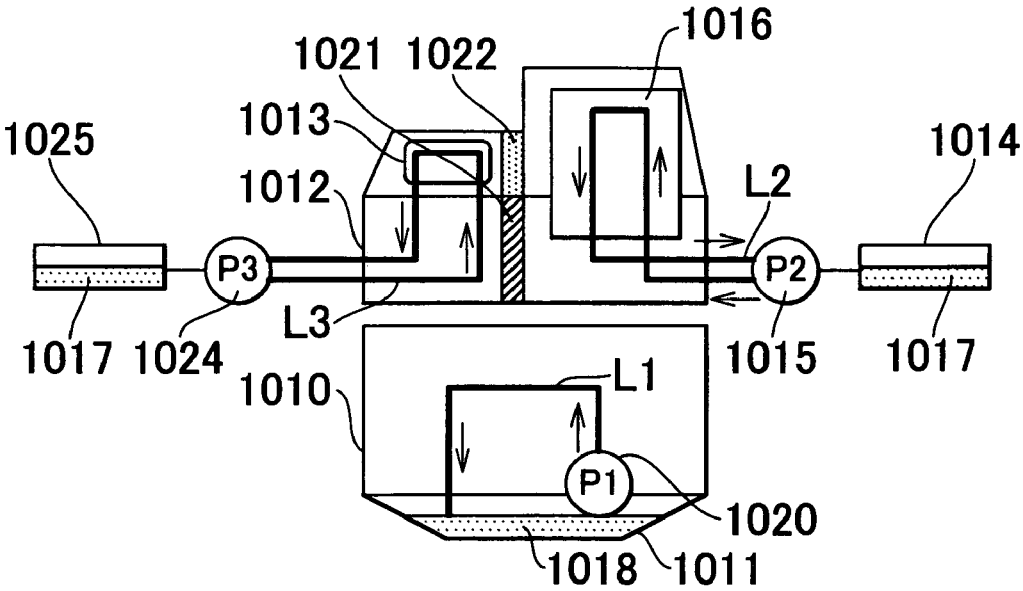
FIG. 9 is a view showing a fifth embodiment for lubricating the internal combustion engine having the half-cam-less structure.

As shown in FIG. 9, a fifth embodiment has a structure corresponding to (C) where the lubricating oil passages L1, L2 and L3 are independently provided like the second embodiment like the fourth embodiment.

Unlike the fourth embodiment, the fifth embodiment uses different types of the lubricating oil for the lubricating oil passages L1, L2 and L3, respectively. The viscosity of the lubricating oil for the electromagnetically driven valve is lower than that of the lubricating oil for the cam driven valve. The viscosity of the lubricating oil for the cam driven valve is lower than that of the lubricating oil for the cylinder block. The aforementioned structure is considered as being the most preferable because lubrication is performed using the lubricating oil with the viscosity in accordance with the elements of the respective sections to be lubricated. As the respective passages L1, L2 and L3 are independently provided, each lubricating oil in those passages is allowed to perform lubrication without being influenced by one another. As the lubrication is performed using the lubricating oil in accordance with the respective sections, those sections may be lubricated appropriately.

The invention is structured such that the lubricating oil for the electromagnetically driven valve is not mixed with other lubricating oil for lubricating other sections. Accordingly, the lubricating oil that has been degraded by lubrication for the other sections is not supplied to the electromagnetically driven valve. This makes it possible to allow the electromagnetically driven valve to be normally operated, resulting in appropriate operation of the internal combustion engine.

What is claimed is:

1. An internal combustion engine, comprising:

a block section that includes a piston and a crankshaft connected thereto;

an electromagnetically driven valve driving one of an intake valve and an exhaust valve; and a cam driven valve driving the other valve;

a first lubricating oil passage being formed to the electromagnetically driven valve; and a second lubricating oil passage being formed separately non-communicating from the first lubricating oil passage, and being formed to the cam driven valve and the block section.

2. The internal combustion engine according to claim 1, wherein lubricating oil supplied through the first lubricating oil passage to the electromagnetically driven valve has a different type from that of lubricating oil supplied through the second lubricating oil passage.

3. The internal combustion engine according to claim 2, wherein the lubricating oil supplied through the first lubricating oil passage to the electromagnetically driven valve has a viscosity different from that of the lubricating oil supplied through the second lubricating oil passage.

4. An internal combustion engine, comprising:

an electromagnetically driven valve that serves to drive one of an intake valve and an exhaust valve;

a cam driven valve that serves to drive the other valve;

at least two lubricating oil passages, one of the at least two lubricating oil passages being formed to the electromagnetically driven valve independently from the other lubricating oil passage;

a head section that includes the electromagnetically driven valve and the cam driven valve;

a block section that includes a piston and a crankshaft connected thereto;

a first lubricating oil passage to the head section including the lubricating oil passage to the electromagnetically driven valve; and a second lubricating oil passage to the block section, the second lubricating oil passage being formed separately, and non-communicating from the first lubricating oil passage wherein the lubricating oil passage to the electromagnetically driven valve, a third lubricating oil passage to the cam driven valve, and the second lubricating oil passage to the block section are independently formed.

5. The internal combustion engine according to claim 4, wherein each of the lubricating oil supplied through the first lubricating oil passage to the electromagnetically driven valve, the third lubricating oil passage to the cam driven valve, and the second lubricating oil passage to the block section has a different type from one another.

6. The internal combustion engine according to claim 5, wherein each viscosity of the lubricating oil supplied through the first lubricating oil passage to the electromagnetically driven valve, the third lubricating oil passage to the cam driven valve, and the second lubricating oil passage to the block section is different from one another.

7. An internal combustion engine, comprising:

a head section;

a block section that includes a piston and a crankshaft connected thereto;

an electromagnetically driven valve driving one of an intake valve and an exhaust valve, the electromagnetically driven valve formed in the head section;

a cam driven valve formed in the head section and driving the other valve;

a first lubricating oil passage being formed to the electromagnetically driven valve and the cam driven valve; and a second lubricating oil passage being formed separately, and non-communicating from the first lubricating oil passage, and being formed to the block section including the piston and crank shaft.

8. The internal combustion engine according to claim 7, wherein lubricating oil supplied through the first lubricating oil passage to the electromagnetically driven valve has a different type from that of lubricating oil supplied through the second lubricating oil passage.

9. The internal combustion engine according to claim 8, wherein the lubricating oil supplied through the first lubricating oil passage to the electromagnetically driven valve has a viscosity different from that of the lubricating oil supplied through the second lubricating oil passage.

* * * * *